US009623421B2

(12) United States Patent
Bolla et al.

(10) Patent No.: US 9,623,421 B2
(45) Date of Patent: Apr. 18, 2017

(54) ECOCOMPATIBLE CONTAINER FOR THE RECYCLING OF CIGARETTE BUTTS

(71) Applicants: Stefano Bolla, Rome (IT); Manfredi Mancinelli Scotti, Rome (IT)

(72) Inventors: Stefano Bolla, Rome (IT); Manfredi Mancinelli Scotti, Rome (IT)

( * ) Notice: Subject to any disclaimer, the term of this patent is extended or adjusted under 35 U.S.C. 154(b) by 0 days.

(21) Appl. No.: 15/102,323

(22) PCT Filed: Dec. 4, 2014

(86) PCT No.: PCT/IB2014/066590

§ 371 (c)(1),
(2) Date: Jun. 7, 2016

(87) PCT Pub. No.: WO2015/087212

PCT Pub. Date: Jun. 18, 2015

(65) Prior Publication Data

US 2016/0296938 A1 Oct. 13, 2016

(30) Foreign Application Priority Data

Dec. 12, 2013 (IT) ..... 2013A0684

(51) Int. Cl.
*B30B 11/24* (2006.01)
*B30B 12/00* (2006.01)
(Continued)

(52) U.S. Cl.
CPC ..... *B02C 17/1855* (2013.01); *A24F 19/005* (2013.01); *A24F 19/0021* (2013.01);
(Continued)

(58) Field of Classification Search
CPC B30B 12/00; B30B 11/24; B30B 3/06; B30B 9/20; B07B 1/24; B07B 13/00;
(Continued)

(56) References Cited

U.S. PATENT DOCUMENTS 3,093,325 A 6/1963 Bambi
4,598,721 A * 7/1986 Stiller ..... B30B 11/221 131/375
(Continued)

FOREIGN PATENT DOCUMENTS

DE 43 19 957 11/1994
WO 2007/026385 3/2007

OTHER PUBLICATIONS

International Search Report dated Apr. 10, 2015, corresponding to PCT/IB2014/066590.

*Primary Examiner* — Jimmy T Nguyen
(74) *Attorney, Agent, or Firm* — Young & Thompson

(57) ABSTRACT

An ecocompatible container for recycling cigarette butts is constituted by a cylinder including an openable upper cover, a base and an intermediate portion which houses a common hopper in external communication with ashtrays through which the cigarette butts are introduced, wherein via the hopper, the butts are introduced into a screening basket with balls, in which the rotation of the screening basket allows, by mutual impact and friction of the balls, crushing the cigarette butts and hence effectively separating the organic portion, i.e. the filter paper and the residual tobacco that fall by gravity through holes into an underlying suitable collection container, from the resistant, fibrous portion constituted only by the filters of the cigarettes which, when sucked by a small suction motor, will fall into an underlying filter accumulation chamber.

10 Claims, 3 Drawing Sheets

(51) Int. Cl.

| | |
|---|---|
| ***B02C 17/18*** | (2006.01) |
| ***B02C 17/00*** | (2006.01) |
| ***A24F 19/00*** | (2006.01) |
| ***B02C 17/02*** | (2006.01) |
| ***B07B 1/24*** | (2006.01) |

(52) U.S. Cl.
CPC ..... *B02C 17/007* (2013.01); *B02C 17/02* (2013.01); *B02C 17/1865* (2013.01); *B07B 1/24* (2013.01); *B30B 11/24* (2013.01); *B30B 12/00* (2013.01)

(58) Field of Classification Search
CPC .... A24F 19/0021; A24F 19/005; A24F 19/10; A24F 19/0071; B02C 17/1865; B02C 17/02; B02C 17/007; B02C 17/1855
USPC ..... 100/102; 209/293, 664
See application file for complete search history.

(56) References Cited

U.S. PATENT DOCUMENTS

| | | | | | |
|---|---|---|---|---|---|
| 4,754,767 | A * | 7/1988 | Graves, Jr. | A24B 3/14 | 131/353 |
| 4,964,425 | A * | 10/1990 | Chang | A24F 19/14 | 131/237 |
| 5,429,310 | A | 7/1995 | Keller et al. | | |
| 5,738,118 | A * | 4/1998 | Ikoma | A24F 19/00 | 131/173 |
| 6,305,552 | B1 * | 10/2001 | Coleman | B07B 1/24 | 209/293 |
| 2009/0065012 | A1 * | 3/2009 | Patel | A24D 1/025 | 131/284 |

* cited by examiner

ECOCOMPATIBLE CONTAINER FOR THE RECYCLING OF CIGARETTE BUTTS

FIELD OF THE ART

The present invention patent application generally refers to the field of eco-compatibility and more particularly to devices for the recycling of cigarette butts. Even if the invention is applicable to any field where one such device type can be advantageously used, this preferably regards the field of recycling plants.

PRIOR ART

As is known, the cigarette end is what remains of a cigarette after its use and it is also termed cigarette butt or, as is widely accepted, simply butt. Notwithstanding their insignificant aspect and inoffensive appearance, butts pose serious problems for the environment since frequent littering leads to their nearly ubiquitous presence.

Cigarette butts, in fact, are the cause of considerable ecological problems both in the field of waste management and in that of forestry management. Such problems are particularly tied to the widespread habit to scatter said butts both in the natural and urban environment, an apparently innocuous behavior that however involves grave environmental consequences. In addition to the ecological consequences, the dissemination and ubiquity of cigarette ends in public spaces is also perceived as one of the most unpleasant symptoms of degradation of the environmental and urban setting.

Cigarettes, and above all their filters, are among the most omnipresent waste and according to a recent study it is estimated that, worldwide, the number of cigarette ends dispersed in nature each year amounts to 4,500 billion, a very high percentage (between 75 and 97%) of those actually smoked. The smoking prohibition in certain restaurants/bars or other areas seems to exacerbate the littering problem, since the smokers are obliged to smoke outdoors, where it is more probable that the butt will be improperly eliminated.

The latency time in nature, before decomposition has been completed, varies from six months to a dozen years depending on the environmental conditions. Nevertheless, the problems are aggravated if the filter per se is not considered, but rather the smoked cigarette butt.

The filter is made with cellulose acetate fibers, glued by glycerol triacetate and covered with common paper. The filter is a structure with improper name, since it retains only a minimum part of the combustion products; this cannot be otherwise, since the pharmacologically active substances released by the burning of the tobacco must be inhaled. Nevertheless, a small part of the over 4,000 toxic substances remains in the filter. There is not precise data on the quantity and nature of the substances that remain trapped in the filter, since each producer uses different additives. In addition, the residual part that remains in the filter depends, in terms of quality and quantity, also on the smoker's manner of smoking. Nevertheless, it is assumed that at least 250 of the substances intercepted in the filters are highly harmful. Among the risk substances, the most well-known are the cancerogenic substances such as benzopyrene, phenol and formaldehyde; heavy metals such as arsenic, lead and cadmium; toxic substances such as acetone, toluene, nicotine, benzene, hydrocyanic acid, acetaldehyde, nitrates; dangerous substances such as butane and ammonia; and radioactive substances such as polonium 210.

The problem arises from the release and dispersion into the environment of these substances, through the micro-pollution diffused and carried by the enormous mass of littered butts. Since most of the cigarette ends are exposed to water, there is the problem of water pollution. A portion of the cigarette ends in fact ends up in the sewer channels while another portion is easily transported by the runoff water until reaching the waterways.

A further problem is constituted by the serious danger that young children can be poisoned by swallowing cigarette butts or in any case by putting them in their mouths.

Up to now, great effort has been employed in the attempt to recycle such butts and in some cases these attempts have worked successfully. Effective recycling processes carried out in valid plants allow obtaining, from the plastic substance represented by the cellulose acetate, forming the cigarette filter, diverse plastic objects such as handbags, toys, fabrics, watches and sunglasses; over approximately 186 different products, obtained from the recycling of cigarettes. The main problem, however, in the pre-recycling step, is that of the storage, collection, handling and separation of the so-called special portion, such as the filter of the cigarette butt, from the more innocuous portion termed organic portion and characterized by the filter paper and the residual tobacco.

Therefore, a fundamental object of the present invention generally consists of attaining a device capable of separating the aforesaid two constituents of the butt, i.e. the filter from the paper and residual tobacco, as well as obtaining such separation at the origin, that is at the point of collection where the butts are directly disposed of by the smokers.

Further object is that of transforming said special waste already at the origin, in a manner such that it can be easily handled during collection by the assigned personnel, i.e. in a manner so as to limit to a minimum the harmful emissions by the filters, also during storage and collection.

A more particular object is to provide a container for cigarette butts that has a design such to attract the attention of passers-by and hence stimulate the desire to use it.

Other advantages of the invention will be clear from the detailed description of an exemplifying and non-limiting embodiment thereof, illustrated hereinbelow.

DESCRIPTION OF THE INVENTION

The inventive concept underlying the present invention consists of providing for an innovative ecocompatible container for the recycling of cigarette butts to be positioned at the edge of sidewalks or in any case where there is high consumption of cigarettes.

As mentioned above, in this manner an apparatus is obtained that is capable of allowing the separation of the so-called special portion, such as the used filter of the cigarette butt—i.e. the contaminated and highly polluting portion—from the more innocuous portion termed organic portion and simply characterized by the filter paper and the residual tobacco.

Said separation characteristic is obtained by using a common ball mill equipped with horizontal-axis basket of screen type. The aforesaid separation step occurs in said basket by means of the impact of the cigarette butts against the balls (of suitable consistency and weight) in a manner such that the rubbing between the layers of material exclusively removes the soft, non-fibrous part of the cigarette butt. More simply stated, there is the removal of the filter paper and the residual tobacco from the filter of the cigarette, by means of performing an operation of mincing and pressing between the balls and against the perforated walls (screen) of the rotary basket. The passage through said calibrated holes (screen) of the rotary basket will allow the falling by gravity of the aforesaid minced portions, constituted only by the filter paper and the residual tobacco, into the suitable underlying collection container.

The discharge of the portion constituted by the filters—which remained nearly intact in the rotary basket due to their intrinsic fibrosity—together with said balls is obtained by means of an air suction flow passing through the basket itself and directed upward into the fixed lateral portion of said ball mill. Said suction, carried out after the step of screening the filter paper and the tobacco, is also carried out during the continuous rotation of the basket and allows the collection and then deposition of only said cigarette filters in the filter collection chamber.

A preferred embodiment of the invention provides that the deposition of the filters occurs in a common compactor chamber, constituted by a common compactor capable of rendering said collected filters compact, in a manner so as to form parallelepiped-shaped sandwiches which are accumulated in the filter collection chamber below the aforesaid compactor chamber.

Hence, with said operation in the aforesaid inventive ecocompatible container for the recycling of cigarette butts, there will be an effective separation of the filter paper/residual tobacco and the cigarette filter, greatly facilitating the subsequent recycling operations of the cigarette filters in the suitable plants.

A further and fundamental objective of the present invention is obtained through the safe compaction and relative accumulation of said filters in a suitable container that can be externally emptied. Such collection of the single parallelepiped-shaped sandwiches will occur in conditions of maximum safety by the personnel assigned for emptying, and the safety of the surrounding environment is also ensured since the packing already per se represents a process capable of carrying out an effective and near-total reduction of the transfer of harmful substances contained in the filters themselves.

Another characteristic technique the differentiates the ecocompatible container, subject of the present invention, is that it is easily adapted to be made with an external shape and with a pigmentation such to be able to attract the attention of passers-by as well as stimulate the use thereof by smokers.

For exemplifying and non-limiting purposes of the embodiment of the present invention, the inventive container of such type can have an external shape and a pigmentation that could recall a lit cigarette, for example with the base representing the portion of the filter, the upper part representing the rod of the cigarette and the lid of the container representing the lit tobacco portion.

Another objective is to obtain modular and scalable components, in a manner such that said inventive container is usable according to multiple types and different complexity levels, being adapted to the various installation and use requirements.

A still further objective is to propose an inventive ecocompatible container that can be manufactured on an industrial scale, whose components are of standard type and can be easily found on the market, and whose production is fully sustainable from an economical and environmental standpoint.

With regard to the constituent materials of said inventive ecocompatible container, these can be selected by the man skilled in the art in order to meet the technical characteristics in this particular field, which include solidity, strength, anti-corrosiveness, resistance upon prolonged contact with water and being fireproof; said materials can comprise those of metallic type, preferably steel and/or special steel and/or aluminum, and/or polymers of plastic type. In addition, said plastic polymer materials or metallic materials can comprise those having galvanized external finish and/or having painted external finish and/or having plasticized external finish.

With regard to the size of said inventive ecocompatible container, it should be stated that this is merely indicative and non-limiting of the invention, though nevertheless the size of said inventive ecocompatible container can be expressed and overall summarized, with regard to the diameter, in an interval comprised between 140 cm and 40 cm and more preferably is 80 cm, and with regard to the height in an interval comprised between 170 cm and 100 cm and more preferably is 130 cm.

Other characteristics of the present invention are described in the following detailed description of one or more specific embodiments, protected by the various dependent claims.

BRIEF DESCRIPTION OF THE DRAWINGS

The previous advantages, as well as other advantages and characteristics of the present invention, will be illustrated with reference to the enclosed figures, which are to be considered as mere non-limiting and non-binding example for the purpose of the present patent application, in which.

DESCRIPTION OF THE PREFERRED EMBODIMENTS OF THE INVENTION

It is wished to underline that hereinbelow, for exemplifying and non-limiting purposes, only some of the possible embodiments of the present invention will be illustrated, it being possible to describe many other embodiments thereof on the basis of the particular identified technical solutions.

Figure 1:
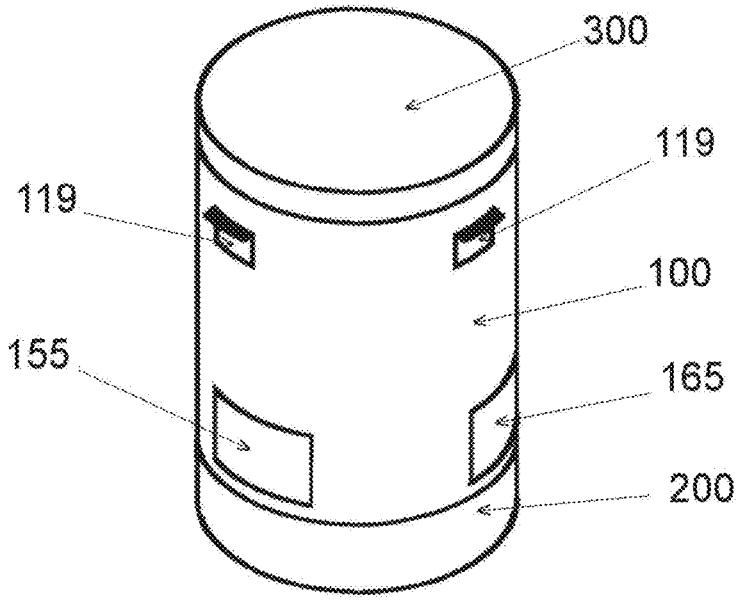
FIG. 1 is a top perspective view of the ecocompatible container according to the present invention.

As shown in FIG. 1, such inventive ecocompatible container for the recycling of cigarette butts is constituted overall by a cylinder comprising an openable upper cover 300 locked by common tamper-proof devices (not shown) and capable of allowing the inspection, verification and manual operation on the various constituent internal devices, by the intermediate portion 100 housing the internal devices and by the base 200 fixed to the ground.

Figure 2:
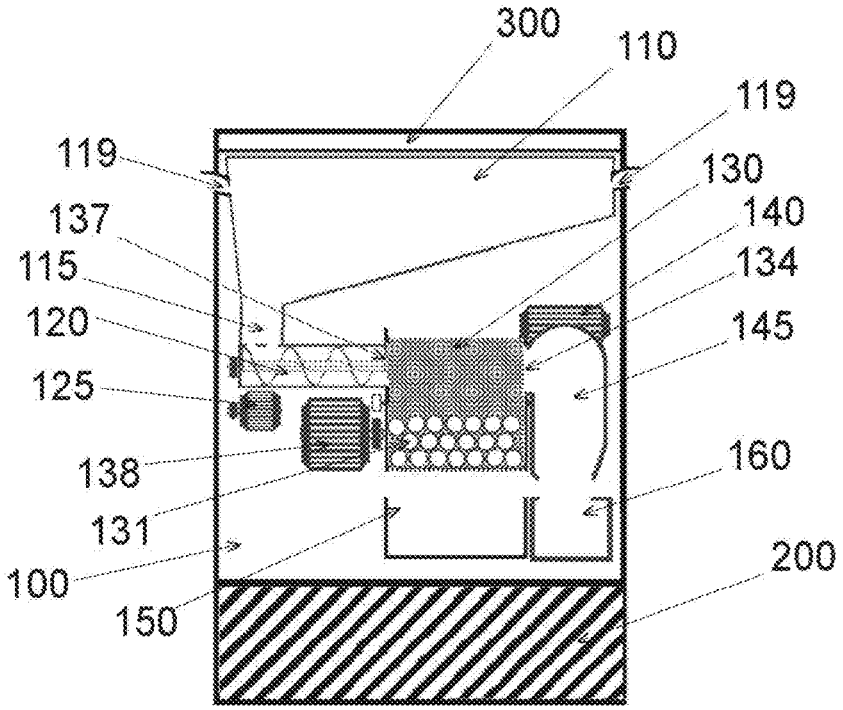
FIG. 2 is a sectioned front view of the inventive ecocompatible container.
Figure 3:
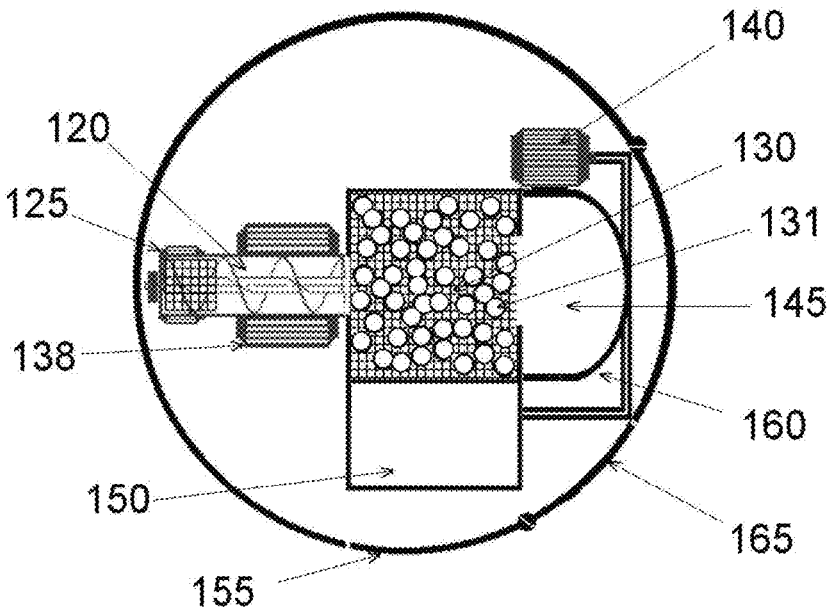
FIG. 3 is a sectioned plan view of the inventive ecocompatible container.
Figure 4:
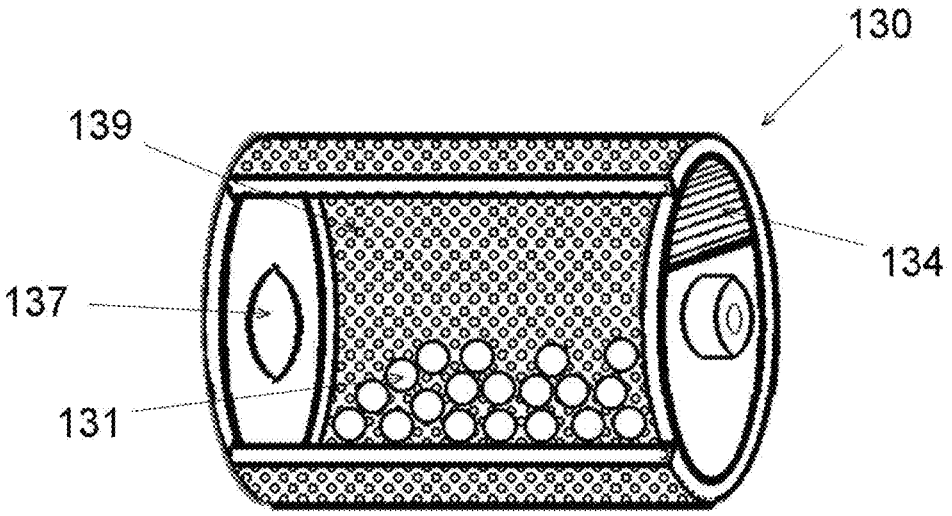
FIG. 4 is an axonometric view of only the rotary basket of the ball mill relative to the inventive ecocompatible container.

As seen in FIGS. 2 and 3, inside said intermediate portion 100, a common hopper 110 is present on the upper part with off-centered lower hole 115, the upper part of which enters into external communication with at least two openings, constituting the ashtrays 119, obtained on the top part of said intermediate portion 100 and through which the cigarette butts or that which remains of a cigarette after its use are introduced, in other words the filter together with the filter paper and the residual tobacco. The off-centered lower hole 115 directly introduces the contents of said hopper 110, i.e. the cigarette butts, into the screw 120 placed horizontally and driven by the small motor of the hopper 125 by means of a suitable belt (not shown). The operation of said screw 120, carried out at specific time intervals, ensures that the material present in said hopper 110, i.e. the cigarette butts, is introduced into the ball mill by means of the opening 137 (FIG. 4) obtained on the side of the screening basket 130. As can be observed in detail in FIG. 4, said ball mill is mainly constituted by a screening basket 130 obtained by a totally perforated hollow cylinder capable of constituting, by means of said holes 139, the screen for the substance to be separated. Indeed, specifically, the rotation of said screening basket 130 by means of the small motor of the basket 138 will move the balls 131 having specially calibrated weight, surface area and size with the relative cigarette butts, allowing by means of mutual impact and friction the crushing of said cigarette butts. Such crushing and rubbing, carried out on said cigarette butts by the aforesaid balls 131, will allow effectively separating the delicate portion i.e. the organic portion that is the filter paper and the residual tobacco from the resistant fibrous portion constituted only by the cigarette filters. Therefore, the aforesaid organic portion, when a suitable mincing size has been attained, will be forced by the pressure exerted by the aforesaid balls 131 to pass through the holes 139 of the aforesaid screening basket 130 and will fall by gravity, being collected in the underlying suitable collection container 150. Said collection container 150 will be sporadically and easily extracted and emptied by the assigned personnel, by opening the door 155 obtained on the lower part of the intermediate portion 100. After a predetermined period useful for completing the passage through the holes 139, due to which it is assumed that the entire organic portion has entirely fallen into the underlying collection container 150, always maintaining the rotation of the screening basket 130 activated, the suction of the residual cigarette filters will occur by means of the driving of the small suction motor 140. Said cigarette filters will be sucked into the superolateral opening 134 of said screening basket 130 (FIG. 4) and directed into the duct 145 (FIG. 2) falling and hence being accumulated in the underlying filter accumulation chamber 160.

Figure 5:
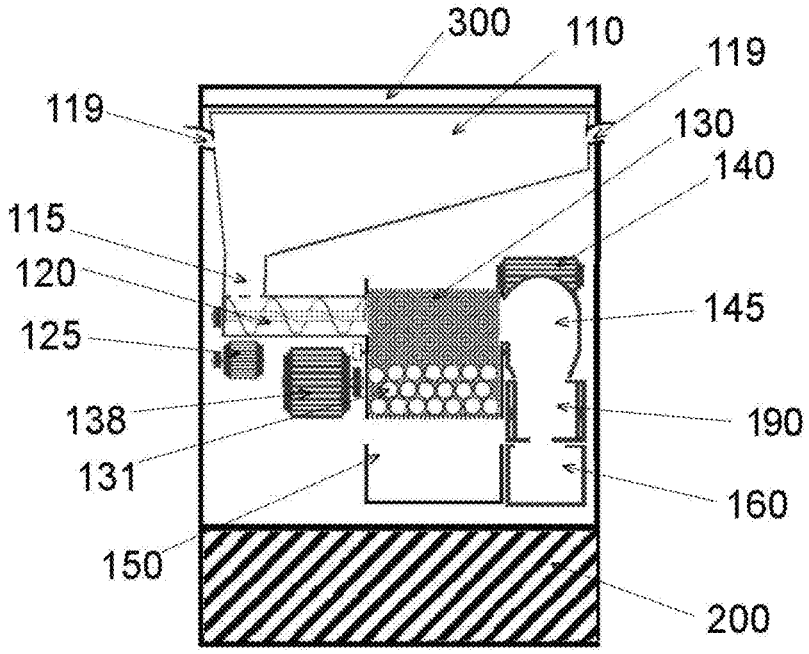
FIG. 5 is a sectioned front view of a further embodiment with the compactor chamber relative to the inventive ecocompatible container.

A preferred embodiment of the invention shown in FIG. 5 and intended to obtain an even more eco-efficient device, provides that said sucked cigarette filters first fall into a compaction chamber 190 directly underneath the aforesaid duct 145. Said compaction chamber 190 is constituted by a common compactor existing on the market, capable of compacting said cigarette filters and to preferably form parallelepiped-shaped sandwiches thereof, in turn introduced and accumulated in the container of the underlying aforesaid filter accumulation chamber 160.

Said filter accumulation chamber 160 will be, in completely safe conditions, sporadically and easily extracted and emptied by the assigned personnel, by opening the door 165 obtained on the lower part of the intermediate portion 100. Once the compaction of the cigarette filters has occurred, these will have greatly reduced volume and hence proportionally the transfer to the environment of the harmful substances absorbed in the filters themselves will be minimized. In addition, the handling of the same filters by the assigned collection personnel will be greatly facilitated, together with the sending to the set recycling plants. Furthermore, the previous step of separating the organic portion from the special portion will greatly facilitate all the recycling operations at the plants dedicated for such purpose.

Figure 6:
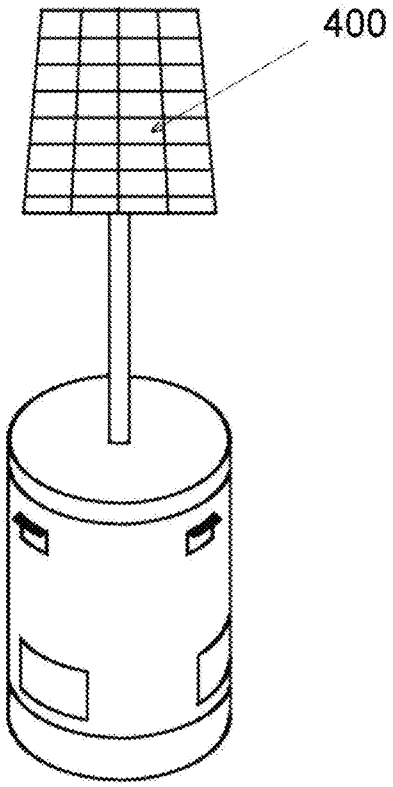
FIG. 6 is a perspective view of an alternative embodiment of the inventive ecocompatible container.

Of course, the inventive structure will require a connection to the power grid, capable of supplying power to the suitable common electronic circuit unit (not shown) in turn capable of suitably controlling, activating for pre-established periods the various electrical devices constituting said inventive ecocompatible container, i.e. the various small electric motors such as the small motor of the hopper 125, the small motor of the basket 138, the small suction motor 140 and the possible electrical device activating the compaction chamber 190. Nevertheless, the present invention provides for further alternative embodiments corresponding with several variants of its structure and shape of its components. Indeed, a further aspect, alongside all the technical solutions described up to now, but of particular importance in the attainment of the invention, is underlined in those cases where it is not desired or it is not possible to have a connection to the power grid. In particular, as shown in FIG. 6, said inventive ecocompatible container is equipped with an optoelectronic device 400 composed of photovoltaic cells capable of converting incident solar energy into electrical energy. More specifically, said photovoltaic cells will have a surface area such to create a power capable of satisfying the electrical requirements of the entire inventive apparatus. Still more particularly, it is provided that the necessary electric current accumulators of the optoelectronic device 400 are housed in the base 200.

Of course, the data provided herein is merely exemplifying and absolutely non-limiting of the range of the present invention, since it serves to extend and not limit the contents of the present invention. Therefore, different, obvious modifications could clearly be made by the man skilled in the art to the preceding exemplifying and non-limiting embodiments described with reference to the figures, without involving an extension beyond the inventive concept that exclusively underlies the following dependent claims.

The invention claimed is:

1. An ecocompatible container for the recycling of cigarette butts, constituted by a cylinder comprising an openable upper cover, an intermediate portion housing internal devices and a base fixed to the ground, the internal devices inside of the intermediate portion comprising a common hopper, a conveying screw, a plurality of ashtrays, a collection container, a small suction motor, a filter accumulation chamber, and a rotating screening basket including a plurality of balls, wherein the common hopper is present on an upper part of said intermediate portion with off-centered lower hole, the upper part of which enters into external communication with at least two openings, constituting the ashtrays, obtained in the upper part of said intermediate portion and through which the cigarette butts or that which remains of a cigarette after its use are introduced, wherein the off-centered lower hole directly introduces the cigarette butts of said hopper, in the screw placed horizontally and driven by a small motor of the hopper, wherein an operation of said screw, carried out at predetermined time intervals, ensures that the cigarette butts present in said hopper, is introduced, by means of an opening obtained on a side of said screening basket, into the screening basket, wherein said screening basket is constituted by a totally perforated hollow cylinder capable of constituting by means of a plurality of holes the screening of a substance to be separated, wherein the rotation of said screening basket will move the balls contained and the relative cigarette butts, allowing by means of mutual impact and friction a crushing of said cigarette butts and hence an effective separation of a delicate portion of said cigarette butts, from a resistant and fibrous portion constituted only by cigarette filters, wherein the delicate portion, when it reaches a suitable mincing size will be forced by a pressure exerted by the balls to pass through the holes of the screening basket and falling by gravity will be accumulated in the underlying collection container, wherein once a passage through the holes is completed, always maintaining the rotation of the screening basket activated, a suction of the cigarette filters will occur by means of a driving of the small suction motor, wherein said cigarette filters will be sucked into a superolateral opening of said screening basket and directed into a duct and wherein said sucked cigarette filters will fall, being accumulated in the underlying filter accumulation chamber.

2. The ecocompatible container according to claim 1, wherein said cigarette filters sucked by means of the driving of the small suction motor are first introduced in a compaction chamber directly underneath the duct, wherein said compaction chamber is constituted by a common compactor, capable of compacting said cigarette filters and of forming parallelepiped-shaped sandwiches thereof, and wherein said parallelepiped-shaped sandwiches are introduced and accumulated in a container placed in the underlying aforesaid filter accumulation chamber.

3. The ecocompatible container according to claim 2, wherein said collection container will be sporadically and easily extracted and emptied by an assigned personnel, by opening a first door obtained on a lower part of the intermediate portion and wherein said container of the filter accumulation chamber will be, in completely safe conditions, sporadically and easily extracted and emptied by the assigned personnel by opening a second door obtained on the lower part of the intermediate portion.

4. The ecocompatible container according to claim 2, wherein it comprises a connection to a power grid capable of supplying power to a common electronic circuit unit in turn capable of suitably controlling, activating for pre-established periods of various electrical devices, wherein said various electrical devices are represented at least by the small motor of the hopper, by a small motor of the screening basket, by the small suction motor and by electrical device activating the compaction chamber.

5. The ecocompatible container according to claim 1, wherein it is power supplied by an optoelectronic device composed of photovoltaic cells capable of converting incident solar energy into electrical energy and wherein electric current accumulators of the optoelectronic device are housed in the base.

6. The ecocompatible container according to claim 1, wherein the openable upper cover is locked by common tamper-proof devices and wherein an opening of said openable upper cover allows an assigned personnel to inspect, verify and manually operate on the internal devices.

7. The ecocompatible container according to claim 1, wherein an external shape of the ecocompatible container simulating a lit cigarette, with the base representing portion of a filter, with the openable upper cover representing a lit tobacco portion and with the intermediate portion representing a rod of the cigarette.

8. The ecocompatible container according to claim 1, wherein constituent materials of the ecocompatible container can comprises those of metallic type, or polymers of plastic type and wherein said plastic polymer materials or metallic materials can comprise those having galvanized external finish and/or having painted external finish and/or having plasticized external finish.

9. The ecocompatible container according to claim 1, wherein the diameter of the ecocompatible container is comprised in an interval between 140 cm and 40 cm, and the height of the ecocompatible container is comprised in an interval between 170 cm and 100 cm.

10. The ecocompatible container according to claim 1, wherein the balls contained in the screening basket have calibrated weight, surface area and size in order to allow, in the cigarette butt, the separation of an organic portion constituted by residual tobacco and filter paper from a special portion constituted only by the cigarette filter.

* * * * *